US006642937B2

(12) United States Patent
Gyarmati et al.

(10) Patent No.: US 6,642,937 B2
(45) **Date of Patent: *Nov. 4, 2003**

(54) SCREEN DISPLAY SYSTEM

(75) Inventors: Sandor Gyarmati, Villingen-Schwenningen (DE); Rainer Schweer, Niedereschach (DE)

(73) Assignee: Thomson Licensing S.A., Boulogne (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/211,230

(22) Filed: Dec. 14, 1998

(65) Prior Publication Data

US 2002/0089510 A1 Jul. 11, 2002

(30) Foreign Application Priority Data

Dec. 18, 1997 (DE) ..... 197 56 365

(51) Int. Cl.[7] ..... G09G 5/00

(52) U.S. Cl. ..... 345/698; 345/553; 345/544

(58) Field of Search ..... 345/127, 128, 345/129, 131, 132, 138, 141, 471, 472, 629, 670, 658, 553, 571, 544, 543, 551, 535, 698

(56) References Cited

U.S. PATENT DOCUMENTS

| | | | | | |
|---|---|---|---|---|---|
| 5,107,255 | A | * | 4/1992 | Shiraisi | 345/670 |
| 5,539,428 | A | | 7/1996 | Bril et al. | 345/143 |
| 5,598,181 | A | * | 1/1997 | Kermisch | 345/658 |
| 6,208,325 | B1 | * | 3/2001 | Reddy et al. | 345/658 |

FOREIGN PATENT DOCUMENTS

| | | |
|---|---|---|
| GB | 2207029 | 7/1987 |
| GB | 2218881 | 11/1989 |

* cited by examiner

*Primary Examiner*—Xiao Wu
(74) *Attorney, Agent, or Firm*—Joseph S. Tripoli; Brian J. Cromarty

(57) ABSTRACT

The invention relates to a method for displaying screen elements on a reproduction screen. A predetermined number of pixels (Pa1 . . . Pej) of a reproduction line (L1 . . . Lm) are combined to form a cell (C11 . . . Cmn). A reproduction line (L1 . . . Lm) is formed from a fixedly predetermined number of cells (C11 . . . Cmn).

3 Claims, 4 Drawing Sheets

| MaMo | Bits/Pix. |
|---|---|
| 4 pix./Cell | 8 |
| 8 pix./Cell | 4 |
| 6 pix./Cell | 5 |
| | 1 |
| 12 pixel/Cell | 1 |

SCREEN DISPLAY SYSTEM

The invention relates to a method for displaying screen elements on a reproduction screen according to the preamble of Patent claim 1.

PRIOR ART

In principle, two different methods for displaying characters are known. The first method is based on the display of characters and the second method is based on the display of pixels.

In the case of displaying characters, the character form of the individual characters is stored in a ROM table and all the character attributes such as foreground/background colour, flashing, etc. are calculated by a character generator and implemented for an entire character, an entire column or an entire screen.

Graphical images can be realized exclusively by means of a dynamically alterable character set. This means that instead of a predetermined character memory, such as a ROM, the character matrix has to be processed in a dynamic alterable manner in a RAM.

Processing of the characters using so-called window technology or vertical shifting, also called scrolling, is carried out at the character level.

A character-based screen display system generally requires little use of software, a small RAM, but, on the other hand, complex hardware and is limited in terms of its possibilities for displaying graphical elements.

In the case of the pixel-oriented mode of display, it is necessary to copy the complete character matrix line by line into a picture memory in order to generate a complete picture. All of the attributes such as foreground/background colours, flashing, etc. must be calculated by software and the arrangement of pixels must likewise be calculated in accordance with the attribute function of the associated characters, lines and/or screen.

Window technology and vertical shifting are pixel-oriented. overwriting windows or objects are usually realized using multiple-level technology.

A pixel-based screen display system generally requires very complex software, large memories, but relatively simple hardware. Whole-picture-frame pixel graphics can advantageously be created.

INVENTION

The invention is based on the object of specifying a method for displaying characters which has flexibility in the method of display and requires simple hardware.

This object is achieved by means of a method according to claim 1.

Advantageous developments are described in the subclaims.

In the method according to the invention, a specific number of pixels of a reproduction line are combined horizontally to form a cell. A cell may comprise for example 4, 6, 8 or 12 pixels. The number of pixels combined to form a cell is determined by a superordinate reproduction mode. The length of a cell is preferably constant, for example the length is determined by the processing width of a microprocessor that is used, and is thus 32 bits wide given a 32-bit processor. Consequently, the width can be 64 bits if a 64-bit processor is used. However, division into 2×32 bits or 4×16 bits is likewise possible.

Depending on the type of reproduction mode required, attributes such as colour, foreground and background colour, flashing or transparency display may also be contained in a cell, in addition to the pixel contents.

For line-by-line reproduction of the cells on a reproduction screen, the cells are stored in a picture memory with a respective dedicated, assigned address. The required storage capacity is equal to the requisite number of cells of the reproduction mode chosen.

The addressing of the cells in the memory takes place linearly. The number of addresses corresponds to the number of cells to be reproduced.

The linear addressing which is obtained by the inventive storage of the cells advantageously affords a reduction in hardware complexity.

Individual cell-by-cell vertical shifting is possible in a line-by-line manner. In the horizontal direction, this is done according to the cell size.

As a result of the cell-by-cell structure of e.g. objects, the latter can easily be defined by simple addressing. It is thus possible to shift or to copy entire objects or to scroll screen areas.

DRAWINGS

An exemplary embodiment of the invention is explained below with reference to the drawings, in which.

Figure 4:
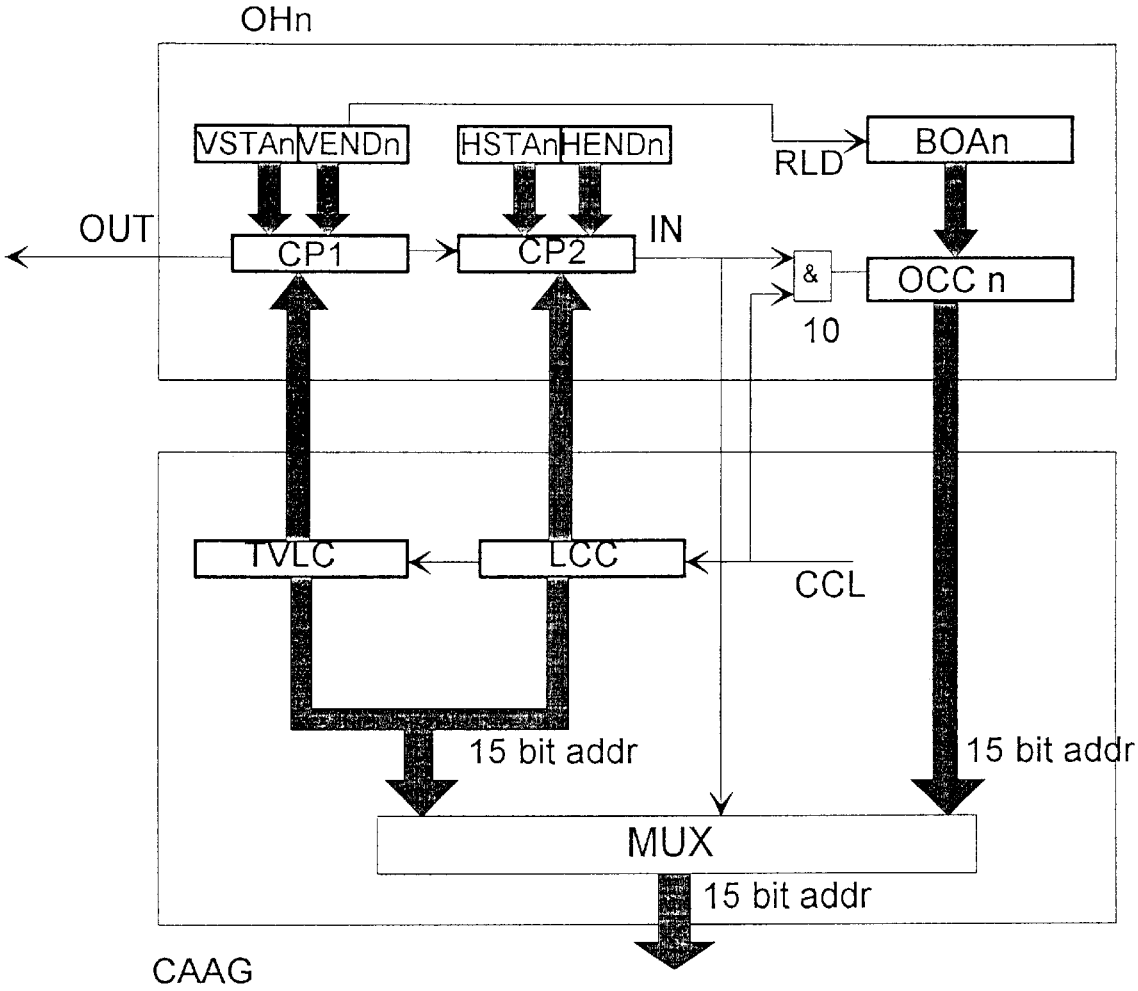
Figure 5:
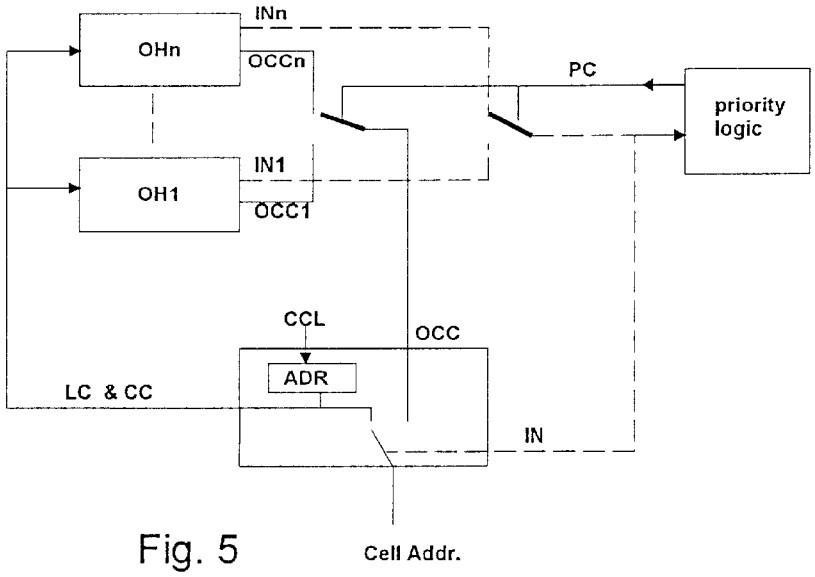
Figure 6:
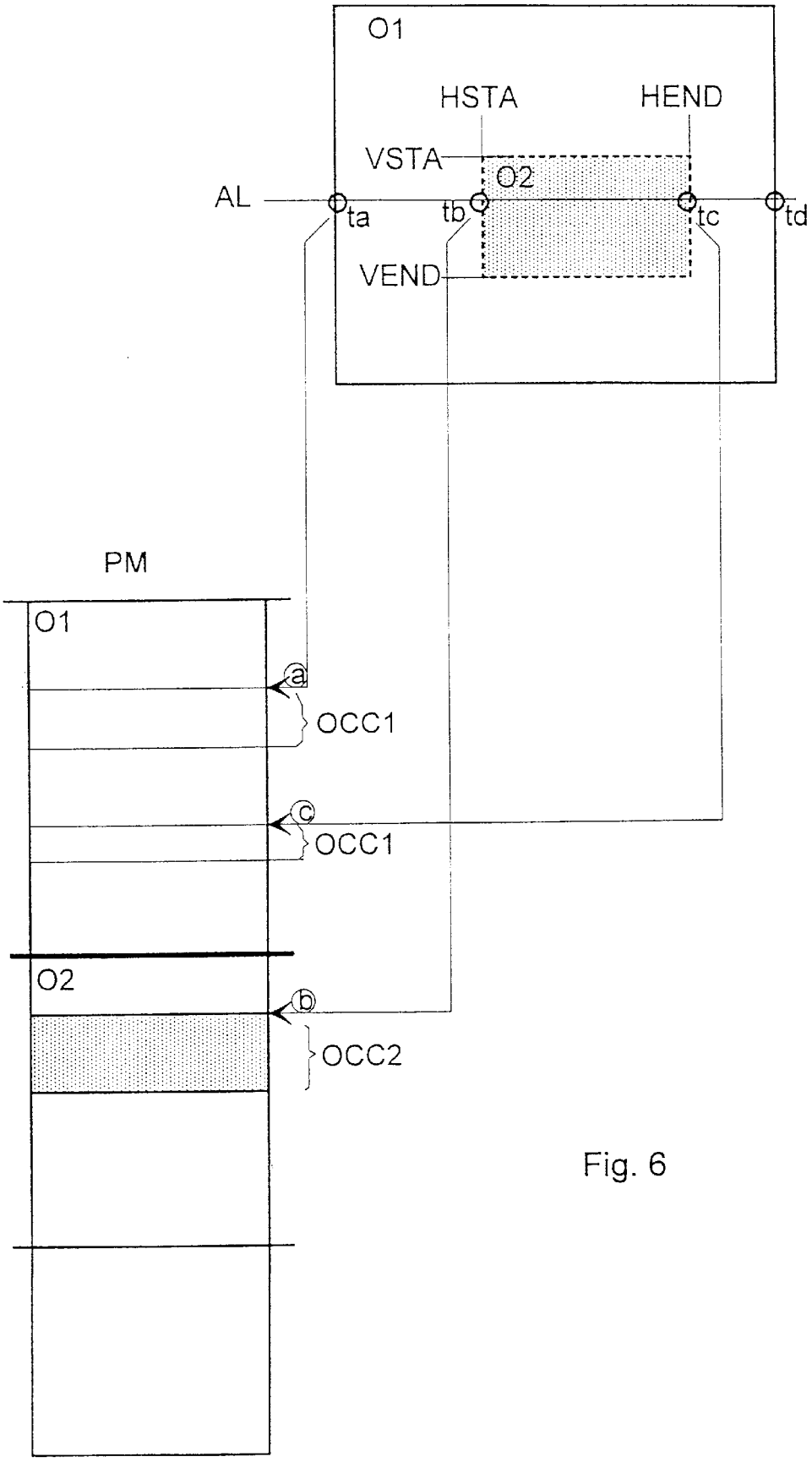

FIGS. 3*a*–3*g* show the structure of a cell,

FIG. 4 shows a block diagram of an object processing device,

FIG. 5 shows an illustration of the processing of different objects,

FIG. 6 shows a storage arrangement of two objects.

EXEMPLARY EMBODIMENTS

Figure 1:
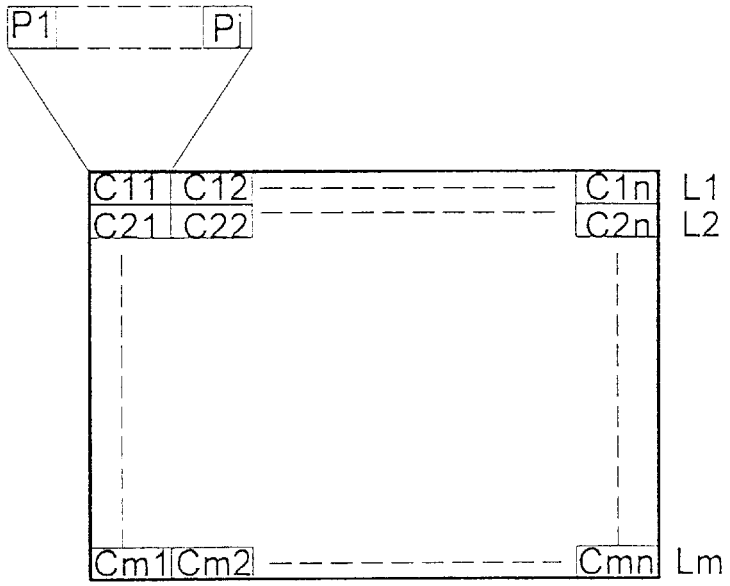
FIG. 1 shows a reproduction screen with cell display.

FIG. 1 shows a reproduction screen with cell display. The screen display consists of lines $L_1$–Lm. n cells $C_{11}$–$C_{1n}$ to $C_{m1}$–$C_{mn}$ are present per line $L_1$–$L_m$. Each cell $C_{11}$–$C_{mn}$ contains j pixels $P_1$–$P_j$.

Consequently, the area of a screen can be described by a total of m×n cells.

Figure 2:
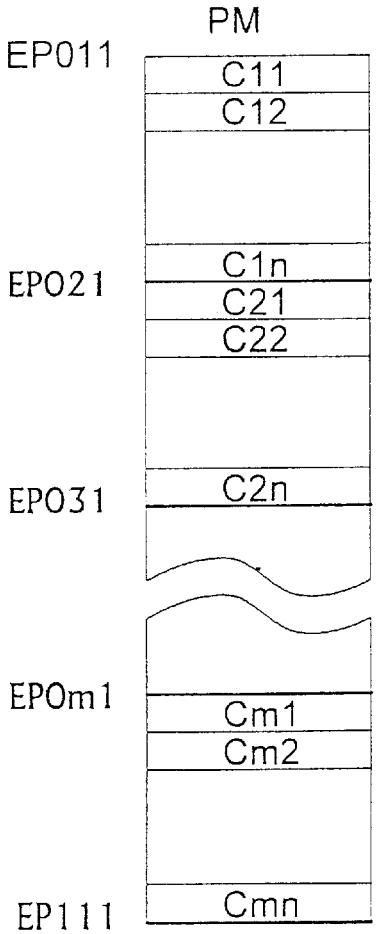
FIG. 2 shows a picture memory.

FIG. 2 shows a picture memory PM, in which the cells $C_{11}$–$C_{mn}$ are stored linearly. It is possible for particular entry points EP for specific objects to be defined which are newly evaluated in each line. Thus, for a first object (No. 0), the picture memory PM starts with the entry point EP0m1 and has its last entry point EP0m1 at the beginning of the last line, if the first object involves the entire contents of the screen. In FIG. 2, an entry point EP111 at the end of the picture memory area for the first object indicates that a picture memory area for a second object (No. 1) follows.

In order, as in the prior art, to display a character, for example a letter, corresponding cells which are arranged vertically one above the other in the case of the screen display have to be stored in the picture memory PM after the corresponding entry points with an offset in the memory. The lines are read out without an offset, that is to say linearly as they are displayed from left to right. The offset corresponds to the number of cells up to the horizontal recommencement of the character to be displayed, and is a constant value given a desired horizontal pixel and colour resolution.

FIGS. 3*a* to 3*g* show an exemplary embodiment of a cell organization given the use of a 32-bit processor.

In FIG. 3*a*, the first cell is constructed by four pixels Pa1–Pa4, each pixel having 8-bit resolution.

Figures 3F, 3G:
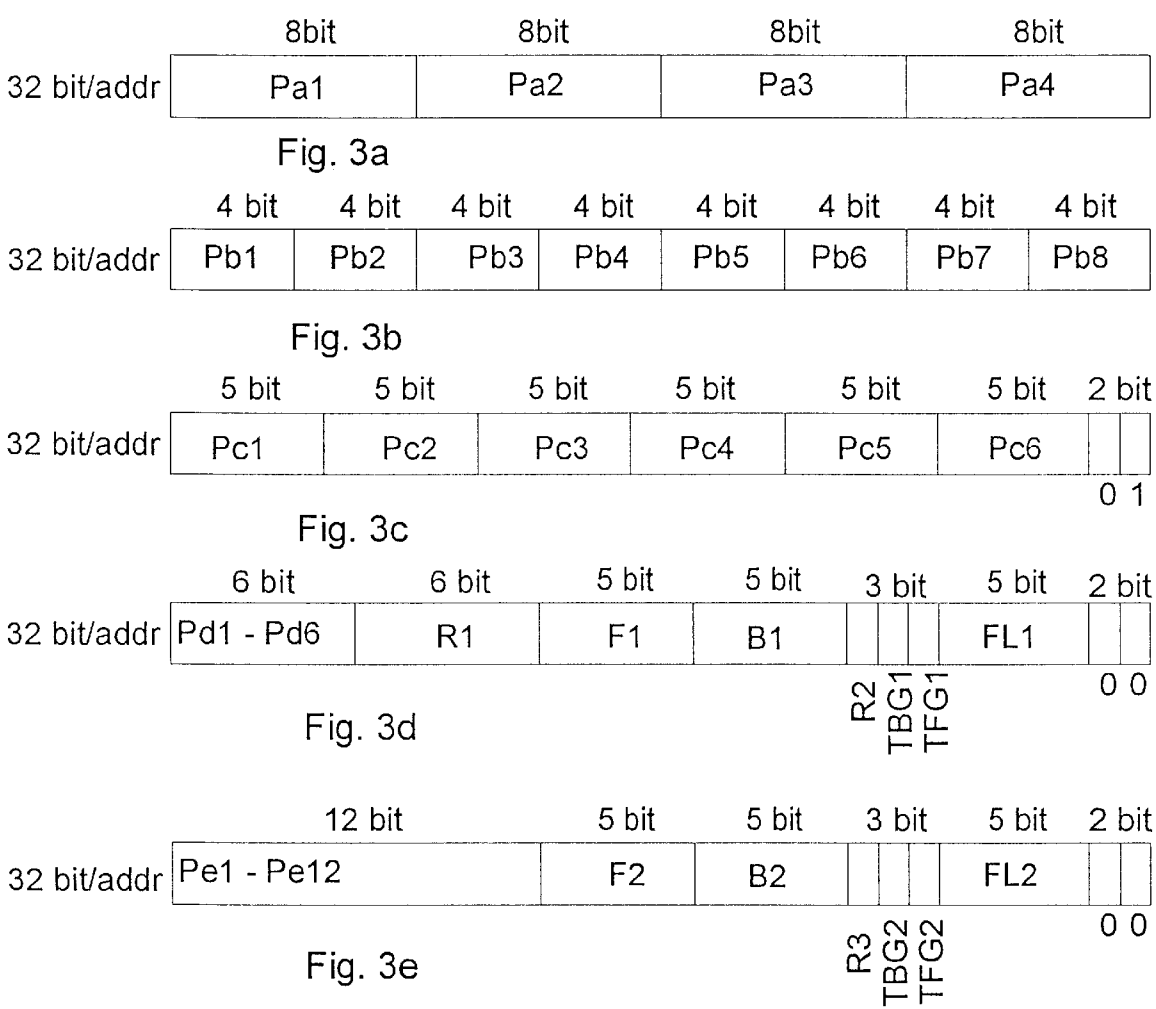

FIG. 3*f* specifies the number of pixels per cell of the cell organization proposed, and FIG. 3*g* specifies the associated resolution per pixel Bits/Pix.

In FIG. 3*b*, a second cell is constructed by 8 pixels Pb1–Pb8, each pixel having 4-bit resolution.

In FIG. 3*c*, a third cell is constructed by 6 pixels Pc1 to Pc6 with a resolution of in each case 5 bits per pixel. The last two bits may serve to identify the type of cell.

In FIG. 3*d*, a fourth cell likewise has 6 pixels Pd1–Pd6. However, in this case the resolution is only one bit per pixel. The pixels Pd1–Pd6 are followed by a block R1 having 6 bits which serves as a reserve, for example. This is followed by a block F1, which may serve to determine the foreground colour. The next block B1 may serve to define the background colour. Both blocks F1 and B1 are each 5 bits wide. The following 3 bits are attributes, in this exemplary embodiment the first bit R2 serving as a reserve, the next bit TBG1 serving for a setting as transparent background and the third bit TFG1 serving as transparent foreground. This is followed by a block FL1, which is 5 bits wide and may contain information regarding a flashing mode. The last two bits in this case also serve the purpose of identification again. The cells illustrated in FIGS. 3*c* and 3*d* are preferably used for teletext display or for the mixed mode of picture and text.

In FIG. 3*e*, a fifth cell is constructed by 12 pixels each having a resolution of 1 bit per pixel. This is followed by blocks similar to those in FIG. 3*d*, namely 5 bits for foreground colour F2, 5 bits for background colour B2, 1 reserve bit R3, 1 bit for transparent background TBG2, 1 bit for transparent foreground TFG2, 5 bits for a flashing mode FL2 as well as 2 identification bits.

This example may preferably be used in a 32-bit computer system. In a 64-bit computer system, the cells proposed in the example can be processed twice in one computation step. Other cell structures are conceivable depending on the type of application and/or on the computer architecture used.

FIG. 4 shows a block diagram of an object processing device. Objects are to be understood as those elements which are to be processed independently, irrespective of other picture contents.

Each object is written cell by cell to the picture memory PM. Objects can be part of the main picture or part of another object. The main picture can also be regarded as an independent object. As already indicated in FIG. 2, each object preferably occupies a picture memory area which is separately assigned to it.

An object is unambiguously described by the following addresses:

1. HSTA=horizontal start position=cell number
2. HEND=horizontal end position=cell number
3. VSTA=vertical start position=line number
4. VEND=vertical end position=line number
5. BOA=base object address, which addresses the first cell of the object.

The object processing device is constructed as follows.

The four corner points of an object on the screen are stored in position memories VSTAn for the vertical start position, VENDn for the vertical end position, HSTAn for the horizontal start position and HENDn for the horizontal end position. The base object address BOA, which refers to the first cell of an object and thus represents the address in the picture memory PM is specified in an address memory BOAn. The position memories VSTAn and VENDn are connected to a first comparator CP1 and the position memories HSTAn and HENDn are connected to a second comparator CP2. In addition, the data of a line counter TVLC are fed to the first comparator CP1 and the data of a cell counter LCC are fed to the second comparator CP2. If the comparison result of the first comparator CP1 is negative, that is to say the instantaneous beam position is outside the object, this information is fed to a second, identically constructed object processing device for an object n–1. If the comparison results of the comparators CP1 and CP2 are positive, the object cell counter OCCn is activated in that the signal IN is fed to the AND gate 10, to whose second input a cell clock signal CCL is applied. This clock signal CCL corresponds to the cell read-out clock signal. The output of the AND gate 10 is connected to a control input of the object cell counter OCCn.

The position memory VENDn is connected to the address memory BOAn via a control line RLD. Data outputs of the address memory BOAn leads to the object cell counter OCCn. The object cell counter OCCn is set to the value of the address memory BOAn if the value of the line counter TVLC exceeds the value of the position memory VENDn. This resetting is effected via the control line RLD between position memory VENDn and address memory BOAn.

The cell clock signal CCLn which is fed to the AND gate 10 simultaneously serves as counting signal for the cell counter LCC and the line counter TVLC. The cell counter LCC counts from 0–127, for example, if a line is described by 128 cells, and the line counter TVLC counts from 0–259 in the case of a TV system having 260 active lines. The data of the cell counter LCC and of the line counter TVLC are fed to an address multiplexer, which switches through either the addresses from the object cell counter or those from the counters TVLC and LCC, depending on the signal "IN". The output signal of the address multiplexer 11 then supplies an address of the picture memory in accordance with FIG. 2.

Each object to be displayed requires its own object processing device. However, the structure is identical for each object processing device. If a plurality of objects are present in one line, a simple priority logic arrangement activates one object processing device after the other. The number of object processing devices is arbitrary, depending on the desired diversity or available chip area. Parts of the object processing device, such as, for example, the line counter TVLC, the cell counter LCC and the address multiplexer, can be combined to form a cell access address generator CAAG and preferably be used jointly for the remaining parts of the object processing devices. The object processing elements VSTA, HSTA, VEND, HEND, BOA and OCC are combined to form an object processing device OH (Object Handler).

FIG. 5 shows an illustration of the processing of different objects. Identically constructed object processing devices OH1 . . . OHn are present altogether. The individual object processing devices OH1 . . . OHn are connected to the outputs of the line counter TVLC and of the cell counter LCC of the cell access address generator CAAG. The content of the object cell counter OCCN and the IN signal are then fed to the cell access address generator CAAG via a priority control PC. Provided that the object cell counter OCCN is within the object window—the IN signal is active—the multiplexer OCCn switches through as addressing for the picture memory PM.

FIG. 6 shows an example of a storage arrangement of two objects O1, O2. For example, the object O1 represents the total available visible screen. The picture memory PM is then read out with the data of the object O1 until, at the instant VSTA2/HSTA2, a further object O2 is to be displayed.

Using the example of an active line AL, at the instant ta the data at the address a, determined by the object cell counter OCC1, are read out and reproduced on the screen. This is done until the instant tb. After the instant tb, the object processing device reveals for the object O1 that the content of the active line AL lies outside the area of the object O1. The priority control PC then switches to the next object processing device, responsible for the object O2. The memory area b, which is defined by the object cell counter OCC2, is then read out. This is done until the instant tc, since here it is again established that the content of the active line AL lies outside the area of the object O2. The priority control PC then switches back again to the object processing device for the object O1 at the instant tc of the object cell counter OCC1.

What is claimed is:

1. A method for displaying screen elements on a reproduction screen, comprising:

subdividing a reproduction line of n-j horizontally adjacent pixels into n equally sized cells of j pixels, wherein each cell comprises only pixels of said reproduction line;

defining independent rectangular screen elements as objects consisting of least one cell;

storing the cells of said objects successively in a picture memory;

reading-out said stored cells from the picture memory; and displaying said read-out cells of said objects, wherein read-out cells are vertically positioned or shifted in a line-by-line manner and horizontally positioned or shifted in a cell-by-cell manner.

2. The method according to claim 1, wherein a cell contains a number of pixels with an assigned resolution and attributes for the assigned mode of display of said pixels.

3. The method according to claim 2, wherein only cells having the same number of pixels but with a differently assigned mode of display are used for each reproduction picture.

* * * * *